US011760601B2

(12) United States Patent
Mack et al.

(10) Patent No.: US 11,760,601 B2
(45) **Date of Patent: *Sep. 19, 2023**

(54) SPOOL DEVICE AND RELATED METHODS

(71) Applicant: Blazing Spools LLC, Scottsdale, AZ (US)

(72) Inventors: Charles Mack, Scottsdale, AZ (US); James Mack, Scottsdale, AZ (US)

(73) Assignee: BLAZING SPOOLS LLC, Scottsdale, AZ (US)

( * ) Notice: Subject to any disclaimer, the term of this patent is extended or adjusted under 35 U.S.C. 154(b) by 546 days.

This patent is subject to a terminal disclaimer.

(21) Appl. No.: 17/011,344

(22) Filed: Sep. 3, 2020

(65) Prior Publication Data

US 2021/0061610 A1 Mar. 4, 2021

Related U.S. Application Data

(63) Continuation of application No. 16/888,072, filed on May 29, 2020, now Pat. No. 10,787,338.

(Continued)

(51) Int. Cl.

| | |
|---|---|
| ***B65H 75/40*** | (2006.01) |
| ***B65H 54/58*** | (2006.01) |
| ***B65H 75/44*** | (2006.01) |

(52) U.S. Cl.

CPC ..... *B65H 54/585* (2013.01); *B65H 75/40* (2013.01); *B65H 75/4492* (2013.01); *B65H 2402/412* (2013.01); *B65H 2701/33* (2013.01)

(58) Field of Classification Search

CPC .. B65H 54/585; B65H 75/40; B65H 75/4492; B65H 2701/33; B65H 2701/332; B65H 2402/412

See application file for complete search history.

(56) References Cited

U.S. PATENT DOCUMENTS

| | | | |
|---|---|---|---|
| 1,048,863 | A | 12/1912 | Notman |
| 1,663,766 | A | 3/1928 | Landis |

(Continued)

FOREIGN PATENT DOCUMENTS

| | | | |
|---|---|---|---|
| CN | 104276457 | A | 1/2015 |
| CN | 108861831 | A | 11/2018 |

(Continued)

OTHER PUBLICATIONS

International Search Report, PCT Patent Application No. PCT/US2020/041673, dated Sep. 28, 2020, 2 pages.

*Primary Examiner* — Sang K Kim
(74) *Attorney, Agent, or Firm* — IPTechLaw

(57) ABSTRACT

Implementations of spool devices may include a frame including an anchor, the anchor configured to directly couple to a belt of a user, an axle coupled through the frame, and a first spool coupled over a first portion of the axle. The first portion of the axle may extend entirely through the first spool. The spool device may also include a second spool coupled over a second portion of the axle. The second portion of the axle may extend entirely through the second spool. The spool device may also include a first spool handle directly coupled to an outer wall of the first spool, a second spool handle directly coupled to an outer wall of the second spool, a first hose roller directly coupled to the frame, and a second hose roller directly coupled to the frame.

20 Claims, 9 Drawing Sheets

Related U.S. Application Data

(60) Provisional application No. 62/894,572, filed on Aug. 30, 2019.

(56) References Cited

U.S. PATENT DOCUMENTS

| | | | | | |
|---|---|---|---|---|---|
| 2,271,136 | A | | 1/1942 | Geiger | |
| 2,393,613 | A | | 1/1946 | Combs | |
| 3,258,220 | A | * | 6/1966 | Munger | B65H 75/406 242/404.1 |
| 3,330,498 | A | | 7/1967 | Rucky | |
| 3,637,158 | A | * | 1/1972 | Jacobsen | H02G 11/02 242/404.1 |
| 3,779,478 | A | | 12/1973 | Fugate | |
| 3,876,045 | A | | 4/1975 | Knarreborg | |
| 4,129,273 | A | | 12/1978 | Hill | |
| 4,137,939 | A | | 2/1979 | Chow | |
| 4,172,567 | A | | 10/1979 | Post | |
| 4,251,038 | A | | 2/1981 | Gename | |
| 4,858,797 | A | | 8/1989 | Rabaska | |
| 5,238,201 | A | * | 8/1993 | Jonushaitis | B65H 75/4478 242/405.3 |
| 5,732,733 | A | | 3/1998 | Negus et al. | |
| 6,241,174 | B1 | | 6/2001 | Nichols | |
| 6,260,803 | B1 | | 7/2001 | Hunts | |
| 6,457,669 | B1 | | 10/2002 | Chuang | |
| 6,824,031 | B2 | | 11/2004 | McKenzie | |
| 7,121,294 | B1 | | 10/2006 | Pierce | |
| 7,530,521 | B2 | | 5/2009 | Punk | |
| 7,984,870 | B2 | * | 7/2011 | Gonzales | B65H 54/585 242/405 |
| 8,151,735 | B1 | | 4/2012 | McCrocklin | |
| 8,205,818 | B1 | * | 6/2012 | Gonzales | B65H 54/585 242/405 |
| 9,004,391 | B2 | | 4/2015 | Fernandez | |
| 9,038,936 | B1 | | 5/2015 | Maddern | |
| 9,601,913 | B2 | | 3/2017 | Killen | |
| 9,617,114 | B2 | | 4/2017 | Shakal et al. | |
| 10,787,338 | B1 | * | 9/2020 | Mack | B65H 75/446 |
| 2005/0051660 | A1 | | 3/2005 | Thomas | |
| 2005/0092696 | A1 | | 5/2005 | Smith | |
| 2005/0103918 | A1 | | 5/2005 | Bedwell | |
| 2008/0023579 | A1 | | 1/2008 | Leonard | |
| 2012/0292428 | A1 | | 11/2012 | Tracy et al. | |
| 2013/0340855 | A1 | | 12/2013 | Simpson et al. | |
| 2015/0075449 | A1 | | 3/2015 | O'Brien et al. | |
| 2015/0259173 | A1 | | 9/2015 | Guiffault et al. | |
| 2017/0239301 | A1 | | 8/2017 | Lucas | |

FOREIGN PATENT DOCUMENTS

| | | | |
|---|---|---|---|
| JP | 3178231 | U | 6/2012 |
| WO | 2004099053 | A2 | 11/2004 |

* cited by examiner

SPOOL DEVICE AND RELATED METHODS

CROSS REFERENCE TO RELATED APPLICATIONS

This document claims the benefit of the filing date of U.S. Provisional Patent Application 62/894,572, entitled "Spool Device and Related Methods" to Charles Mack which was filed on Aug. 30, 2019, the disclosure of which is hereby incorporated entirely herein by reference.

This application is a continuation application of the earlier U.S. Utility patent application to Charles Mack entitled "Spool Device and Related Methods," application Ser. No. 16/888,072, filed May 29, 2020, now pending, the disclosure of which is hereby incorporated entirely herein by reference.

BACKGROUND

1. Technical Field

Aspects of this document relate generally to spool devices, such as spool devices for hoses. More specific implementations involve spool devices for fire hoses.

2. Background

Generally, spools include a cylindrical member which flexible material is wound around. The flexible material may include rope, tubing, or wire. The spools may be used to store the flexible material.

SUMMARY

Implementations of spool devices may include a frame including an anchor, the anchor configured to directly couple to a belt of a user, an axle coupled through the frame, and a first spool coupled over a first portion of the axle. The first portion of the axle may extend entirely through the first spool. The spool device may also include a second spool coupled over a second portion of the axle. The second portion of the axle may extend entirely through the second spool. The spool device may also include a first spool handle directly coupled to an outer wall of the first spool, a second spool handle directly coupled to an outer wall of the second spool, a first hose roller directly coupled to the frame, and a second hose roller directly coupled to the frame.

Implementations of spool devices may include one, all, or any of the following:

The frame may not cross a first plane formed by the outer wall of the first spool and the frame may not cross a second plane formed by the outer wall of the second spool.

The spool device may include a braking system directly coupled to the frame, wherein the braking system is configured to brake the first spool and the second spool through friction.

The spool device may be configured to couple to a front of a user and may be configured to allow a user to spool multiple hoses simultaneously.

The spool device may include a first hub lock configured to secure the first spool over the first portion of the axle and a second hub lock configured to secure the second spool over the second portion of the axle.

The first spool may rotate independently from the second spool.

Implementations of spool devices may include a frame including an anchor directly coupled to an upright, a first support coupled between the upright and an axle receiving portion, a second support coupled between the upright and the axle receiving portion, an upper portion directly coupled to and extending from the upright, the upper portion forming an angle between 90-135 degrees with the upright, and a third support coupled between the upper portion and the axle receiving portion. The spool device may also include an axle coupled through the axle receiving portion, a first spool coupled over a first portion of the axle, a second spool coupled over a second portion of the axle, a first spool handle directly coupled to an outer wall of the first spool, a second spool handle directly coupled to an outer wall of the second spool, a first hose roller directly coupled to the frame, and a second hose roller directly coupled to the frame.

Implementations of spool devices may include one, all, or any of the following:

The first hose roller and the second hose roller may be rotatable.

The spool device may include a hose locking mechanism directly coupled to the upper portion of the frame.

The first hose roller and the second hose roller may be directly coupled to the third support.

The spool device may include a harness. The harness may include a first latch configured to couple to the upper portion of the frame, a second latch configured to directly couple to a user's clothing, and a third latch configured to directly couple to the user's clothing.

The anchor may include a notch configured to couple over a user's belt.

The spool device may be configured to spool devices while the spool device is carried by a user.

Implementations of spool devices may include a frame including an upright coupled to an anchor. The anchor may include a U shape and may be configured to directly couple over a belt of a user. The frame may also include an upper portion directly coupled to and extending from the upright, the upright and upper portion forming an angle therebetween. The spool device may also include a harness directly coupled to the upper portion, an axle coupled to the frame, a first removable spool coupled over a first portion of the axle, a second removable spool coupled over a second portion of the axle, a first spool handle directly coupled to an outer wall of the first removable spool, and a second spool handle directly coupled to an outer wall of the second removable spool. The spool device may be configured to directly couple to the front of a user. The spool device may be configured to allow the user to spool multiple hoses simultaneously while moving.

Implementations of spool devices may include one, all, or any of the following:

The harness may be configured to directly couple to only a single point of the frame.

The spool device may include a first brake coupled to frame, the first brake configured to pivot and engage the first removable spool, and a second brake coupled to frame, the second brake configured to pivot and engage the second removable spool.

The spool device may include a hose locking mechanism directly coupled to the upper portion of the frame.

The spool device may include a first hub lock configured to secure the first removable spool over the first portion of the axle and a second hub lock configured to secure the second removable spool over the second portion of the axle.

The first removable spool and the second removable spool may be configured to rotate independently from one another.

The frame may not cross a first plane formed by the outer wall of the first removable spool and the frame may not cross a second plane formed by the outer wall of the second removable spool.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended spool devices will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such spool devices, and implementing components and methods, consistent with the intended operation and methods.

In various implementations disclosed herein, the spool device may be configured to spool hoses, and in particular implementations, fire hoses. In other implementations the spool device may be configured to spool other hoses aside from fire hoses. In still other implementations, the spool device may be configured to spool non-hose devices, such as, by non-limiting example, rope, cable, or wire.

Figure 1:
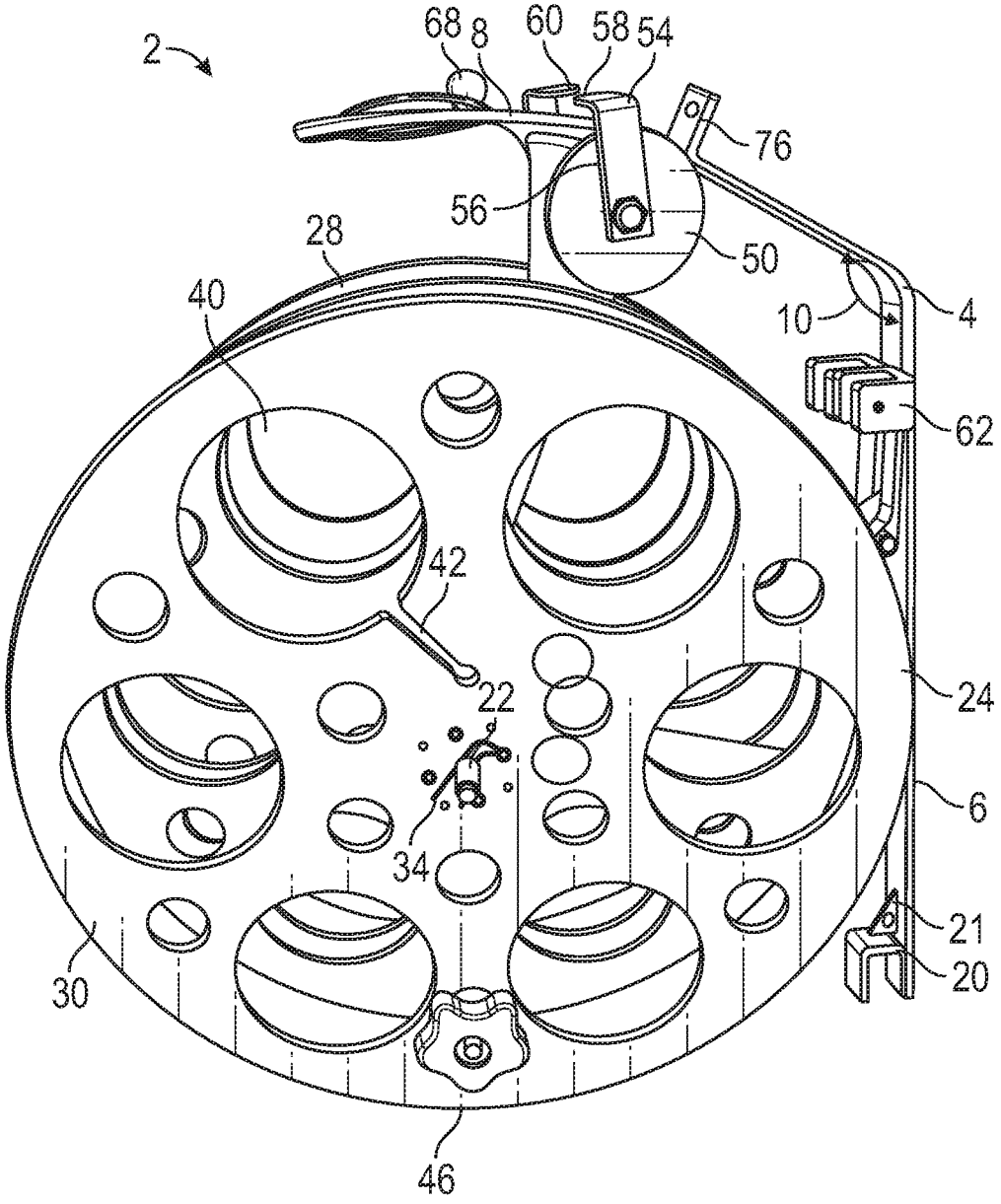
FIG. 1 is a side view of a spool device.
Figure 3:
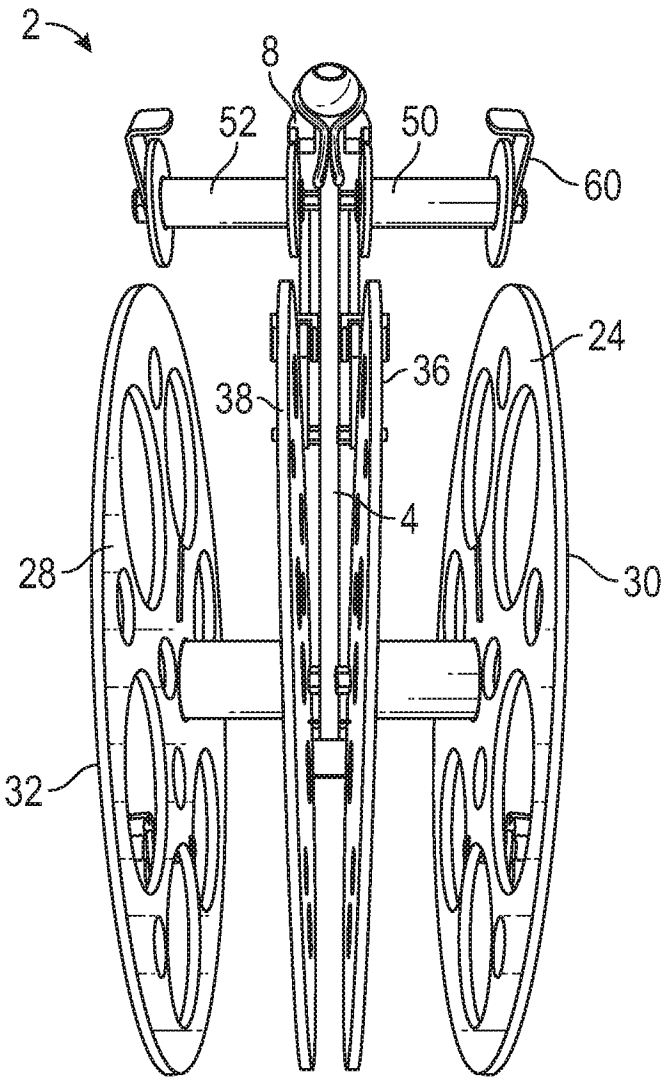
FIG. 3 is a front view of a spool device.
Figure 2:
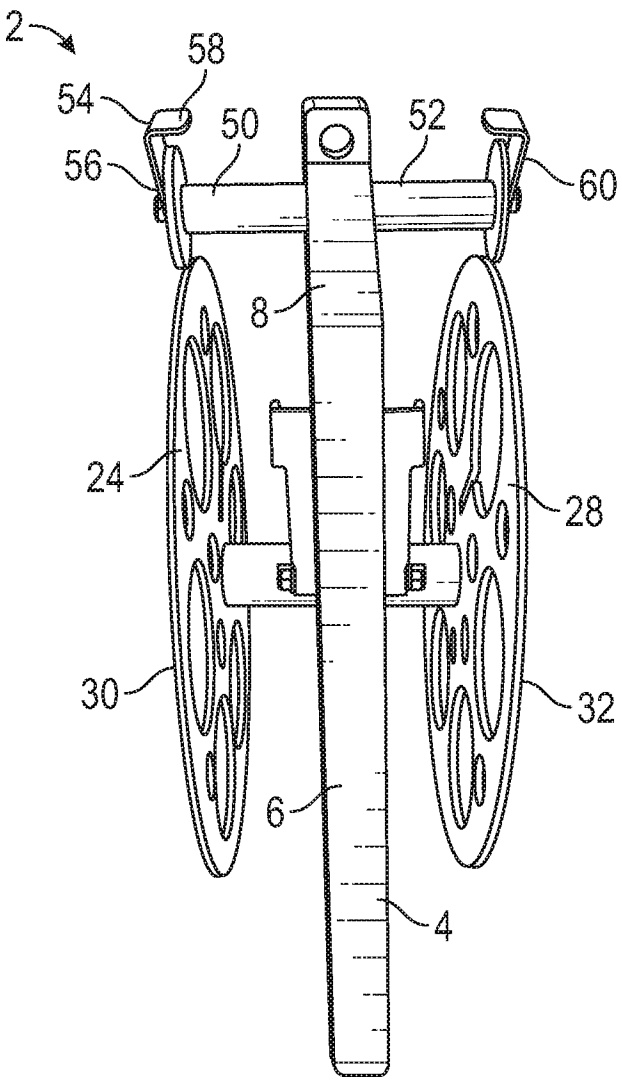
FIG. 2 is a rear view of a spool device.
Figure 4:
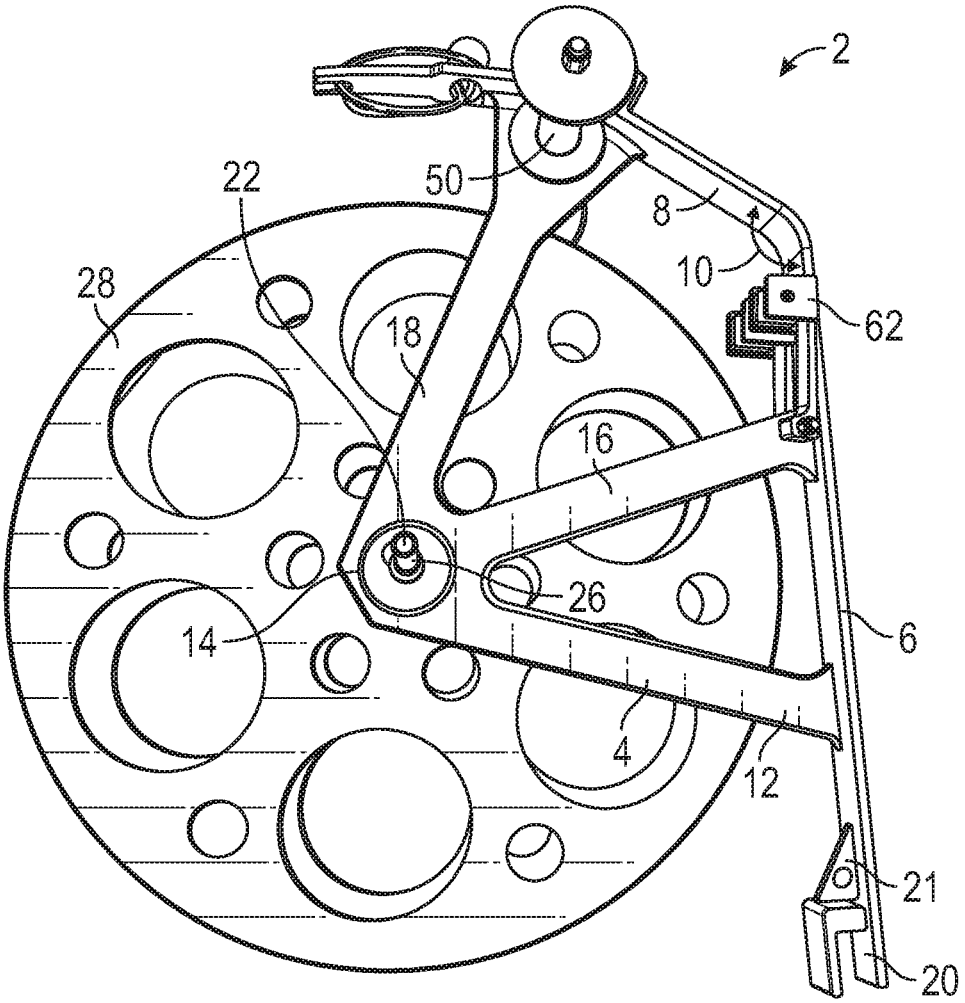
FIG. 4 is a side view of a spool device having a spool removed.

Referring to FIGS. 1-3, a spool device is illustrated. Referring specifically to FIG. 1, a side view of a spool device is illustrated. Referring to FIG. 2, a rear view of the spool device is illustrated. Referring to FIG. 3, a front view of the spool device is illustrated. The spool device 2 includes a frame 4. Referring to FIG. 4, a side view of the spool device having a spool removed is illustrated. The frame 4 may be made from, by non-limiting example, a metal, a plastic, a composite (such as carbon fiber), any other rigid material, or any combination thereof. In particular implementations the frame 4 may include a steel material. The frame 4 may include an upright 6. The upright 6 may is configured to run substantially parallel to a standing user when the spool device 2 is worn on the front of a user, as disclosed herein. In various implementations, the upright 6 may include a handhold or a grip configured to allow a user to hold the upright in order to carry the spool device or operate the spool device.

Figure 11:
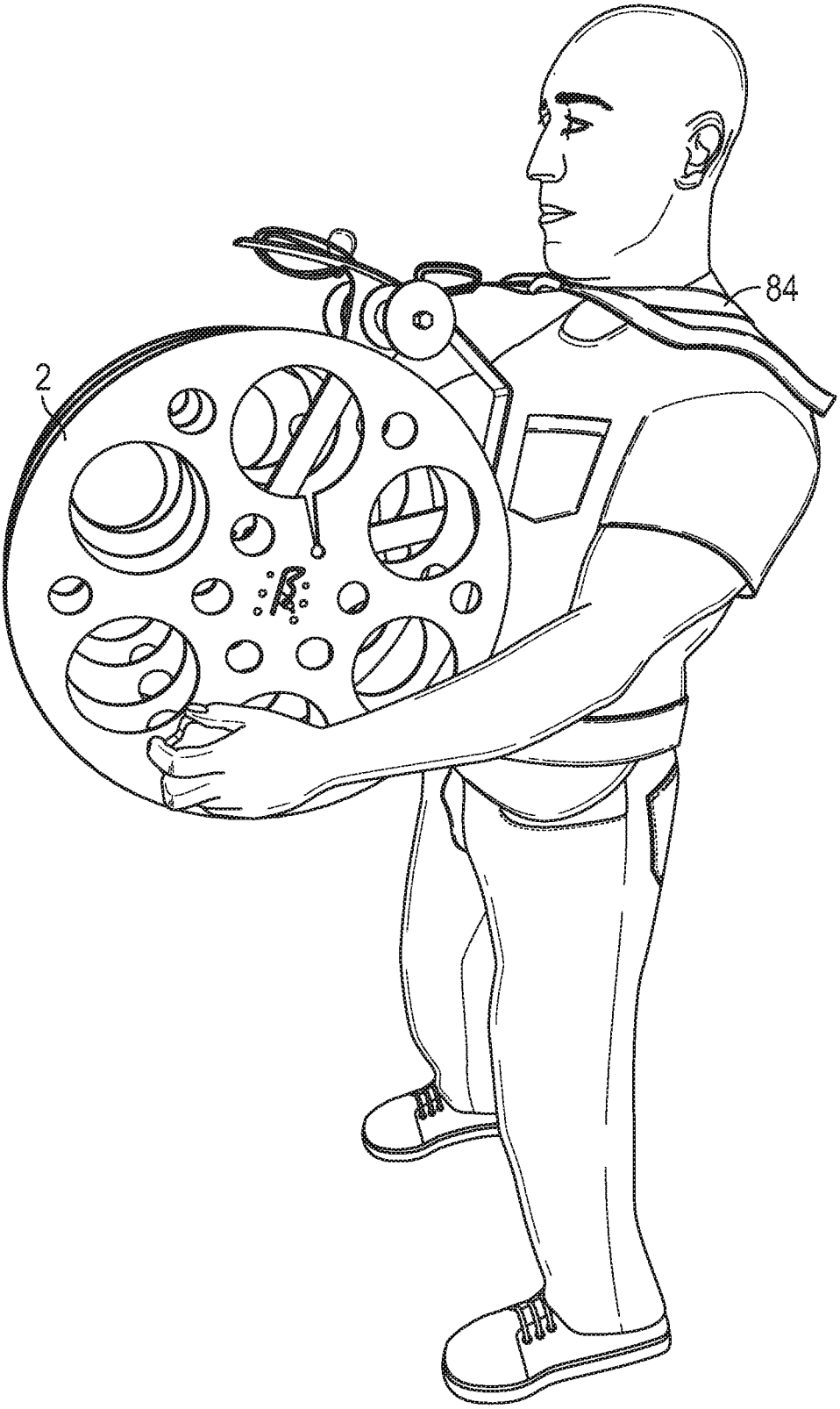
FIG. 11 is a side view of a user with the spool device.

Referring to FIGS. 1-4, the frame includes an upper portion 8 coupled to and extending from the upright 6. In various implementations, as illustrated by FIGS. 1-4, the upper portion 8 may be directly coupled to the upright 6. In other implementations, the upper portion may be indirectly coupled to the upright and directly coupled to a support coupling the upper portion to the axle receiving portion. As used herein, "upper," and other directional terms, are used to describe the spool device 2 as oriented in FIGS. 1-4, or as oriented when worn by a user as illustrated by FIG. 11. In implementations where the upper portion 8 is directly coupled to the upright 6, the upper portion may form an angle 10 with the upright. In particular implementations, the angle formed may be between 90-135 degrees, though in other implementations the angle formed may be less than 90 degrees or more than 135 degrees.

As illustrated by FIG. 4, in various implementations the spool device 2 may include a first support 12 coupled between the upright 6 and an axle receiving portion 14 of the frame 4. The spool device may also include a second support 16 coupled between the upright 6 and the axle receiving portion 14. In particular implementations, and as illustrated by FIG. 4, the spool device 2 may include a third support 18 coupled between the upper portion 8 and the axle receiving portion 14. In various implementations, the axle receiving portion may include an opening configured to receive an axle. In other implementations, a first portion of the axle may be coupled to the first side of the axle receiving portion and a second portion of the axle may be coupled to a second side of the axle receiving portion. In such implementations, the axle may be a single continuous axle or may be comprised of two separate portions. Though not illustrated, in various implementations, the axle receiving portion may include a plurality of openings along a length of the axle receiving portion, each configured to receive an axle. In such implementations, an axle may be placed through various openings depending upon the size of the spools used on the spool device. This allows for a spool to be placed on the frame in a manner that has the outer edge of the spool positioned closely to the user, which in turn allows for easier operation of the spool device as the weight of the spool device is held closely to the user.

Referring to FIGS. 1 and 4, in various implementations the frame 4 includes an anchor 20 which may be directly coupled to the upright 6. The anchor may be configured to attach to an external device which may include, by non-limiting example, a person, a truck, or a wall. In particular implementations, and as illustrated by FIGS. 1 and 4, the anchor 20 is configured to directly couple to a belt of a user. In such implementations, the anchor 20 may include an upside-down "U" shape, or a notch, the "U" shape or notch configured to rest on, or receive and directly couple over, a belt of a user. In such implementations, the weight of the spool device 2 is supported by the user's belt, making it easier for the user to carry and operate the spool device 2. In various implementations the anchor may be adjustable and extendable further from the remainder of the spool device in order to accommodate various heights of users.

As illustrated by FIGS. 1 and 4, in various implementations the frame 4 may include a support 21 coupled between the anchor 20 and the upright 6. In particular implementations, the support 21 may be triangular.

Still referring to FIGS. 1-4, In various implementations the spool device 2 includes an axle 22 coupled through the axle receiving portion 14 of the frame 4. The axle may include any type of material disclosed herein. In various implementations, the axle may be threaded. The axle 22 may be removably fixed in place to the axle receiving portion 14. In other implementations, the axle may be permanently fixed in a single location on the frame through a fixing mechanism such as a weld. While the axle 22 of FIGS. 1-4 extends from both sides of the frame 4, in implementations including only a single spool the axle may extend away from only a single side of the frame.

Still referring to FIGS. 1-4, the spool device 2 includes one or more spools. While the implementation illustrated by FIG. 1 includes two spools, one on each side of the frame, other implementations may include only a single spool on a single side of the frame. In still other implementations, the spool device may include more than two spools with multiple spools on either side of, or on both sides of the frame. The spools may be made from any material disclosed herein. The spools may also include a variety of sizes. In various implementations, the width of the spool may be one inch, less than one inch, or more than one inch. Specifically, the width of the spool may correspond to the width of the hose configured to be wound on the spool. Further, the diameter of the spool may correspond to the length of the hose as it is spooled on the spool.

In particular implementations, the spool device 2 includes a first spool 24 coupled over a first portion 26 of the axle 22 and a second spool 28 coupled over a second portion of the axle 22. In such implementations, the first portion 26 of the axle 22 may extend entirely through the first spool 24. Similarly, the second portion of the axle 22 (extending from the opposite side of the frame as the first portion 26 of the axle) may extend entirely through the second spool 28. In other implementations, the first portion of the axle does not extend entirely through the first spool and/or the second portion of the axle does not extend entirely through the second spool. In the implementation illustrated by FIGS. 1-4, no portion of the frame 4 crosses a first plane formed by the outer wall 30 of the first spool, and no portion of the frame crosses a second plane formed by the outer wall 32 of the second spool.

In various implementations, the first spool 24 and/or the second spool 28 may be removably coupled to the spool device 2. In such implementations, the spool device 2 may include a hub lock 34 coupled configured to secure the first spool 24 over the first portion 26 of the axle 22 and a second hub lock configured to secure the second spool 28 over the second portion of the axle 22. In such implementations, the hub locks may be configured to prevent the spools from sliding off of the axle 22. In various implementations, the hub locks may be threaded onto the axle 22. In other implementations, the hub lock may include a cotter pin, a clasp, or a nut threaded onto the axle 22. Each of the hub locks may be removable to allow spools to be put on and taken off of the axle 22. This may allow for a hose to be wound and retrieved, the loaded spool removed, an empty spool placed back on the axle, and a second hose wound and retrieved. In such implementations, the hoses may be stored on the spools, deployed from the spools when needed for use, and then directly loaded back onto the spools.

The spools are configured to rotate about the axle 22. In various implementations, the first spool 24 may rotate independent from the second spool 28, while in other implementations the first spool and the second spool may rotate dependent to one another and in sync.

Referring to FIG. 3, the first spool includes an inner wall 36 and an outer wall 30 and the second spool 28 includes an inner wall 38 and an outer wall 32. In other implementations, each spool may include only an outer wall and the frame may include a closed area which keeps a hose in place as if there were an inner wall on the spool. In various implementations the outer and inner walls may be predominantly solid and continuous. In other implementations, and as illustrated by FIGS. 1-4, the outer and/or inner walls of any or all of the spools may include a plurality of openings and designs. In such implementations, the openings or designs may reduce the overall weight of the spool device. In particular implementations, the spools may include three large openings in the outer sidewalls of the spools. In such implementations, one of the three openings may be connected to a slot used to secure an end of a hose.

Referring to FIG. 1, the first spool 24 may include a hose end receiving opening 40 coupled to a slot 42. In various implementations, prior to spooling the hose, an end of the hose may be inserted, from within the first spool 24, through the hose end receiving opening 40. The hose may then be inserted within the slot 42. In such implementations, the slot 42 may hold the end of the hose in place to allow the remainder of the hose to be spooled.

Still referring to FIG. 1, the spool device 2 may include a first spool handle 44 directly coupled to an outer wall 30 of the first spool 24. The first spool handle 44 may be configured to allow an individual to ergonomically hold the handle and spool a hose. In various implementations, the spool handle may be rotatable relative to the spool, while in other implementations the first spool handle 44 may be fixed relative to the spool. As illustrated by FIG. 1, the first spool handle may be located near an outer edge 46 of a radius of the first spool 24. In other implementations, the first spool handle may be located near a middle portion of a radius of the first spool 24.

In implementations having a second spool 28, the spool device 2 may include a second spool handle 48 directly coupled to an outer wall 32 of the second spool 28. The second spool handle 48 may be the same as the first spool handle 44, with the only difference being the spool the second spool handle is directly coupled to.

In implementations having a first spool handle 44 and a second spool handle 48, the spool handles may allow for multiple hoses to be spooled simultaneously by a single user as the user rotates the spools with the spool handles.

In various implementations the spool device may include one or more hose rollers. More particularly, the spool device may include a number of hose rollers corresponding to the number of spools coupled to the frame. Referring to FIGS. 1-4, in particular implementations the spool device 2 includes a first hose roller 50 directly coupled to the frame 4 and a second hose roller 52 directly coupled to the frame. In particular implementations, the first hose roller 50 and second hose roller 52 may be directly coupled to the third support 18. In other implementations, the first hose roller 50 and the second hose roller 52 may be directly coupled to the upper portion 8. In various implementations, each of the hose rollers may be rotatable, while in other implementations, each of the hose rollers may be rotatably fixed in place. The hose rollers may be configured to force water (or any other medium) out of a hose. Accordingly, in implementations where the spool device 2 is used without hoses, the spool device may not include any hose rollers.

As illustrated by FIGS. 1-3, the first hose roller 50 may include a first guide 54 configured to keep a hose on the hose roller. In various implementations, the first guide 54 may include a first portion 56 substantially perpendicular to a length of the hose roller which the hose is configured to move over. The first guide 54 may also include a second portion 58 extending from the first portion 56 and configured to extend over the hose when the hose is over the hose roller. In such an implementation, the first guide 54 may prevent the hose from falling off of the hose roller while being spooled. In various implementations, and as illustrated by FIGS. 1-3, the second hose roller 52 may also include a second guide 60. The second guide may be similar to or the same as the first guide 54.

In various implementations the first guide 54 and the second guide 60 may be removably coupled to remainder of the hose rollers. In other implementations, the first guide 54 and the second guide 60 may be fixedly coupled to the hose rollers, and in still other implementations, the spool device 2 may not include any hose rollers. While only FIGS. 1-3 are illustrated as including the first guide 54 and the second guide 60, it is understood that the first guide and second guide may be included in any of the implementations disclosed herein.

Figure 5:
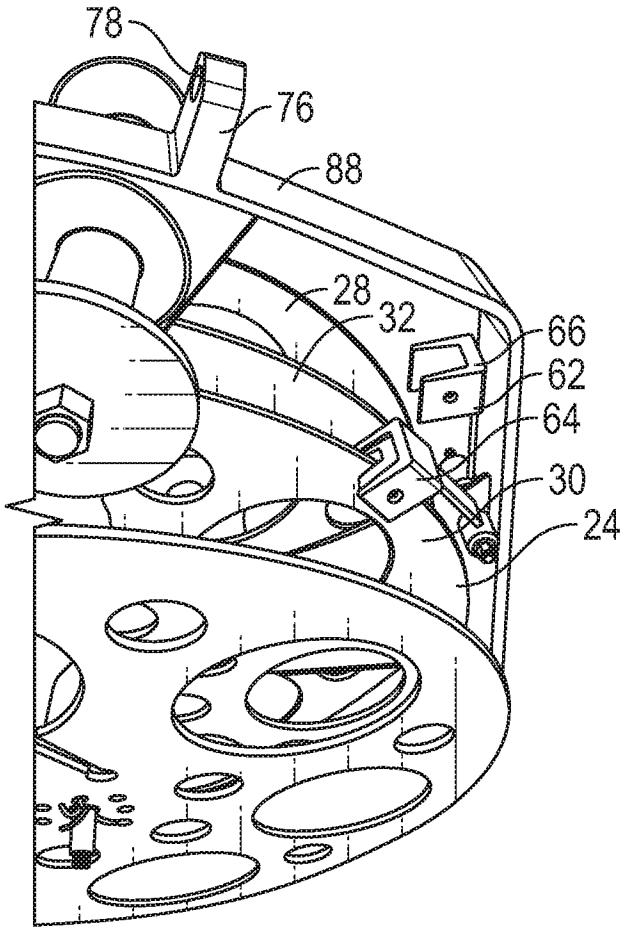
FIG. 5 is a view of a braking mechanism of a spool device.

Referring to FIG. 5, a view of a braking mechanism of a spool device is illustrated. As illustrated by FIGS. 1 and 4-5, the spool device 2 may include a braking mechanism 62. The braking mechanism 62 may be directly coupled to the frame 4 and may prevent the spools from rotating by applying friction to the spools. As illustrated by FIG. 5, the braking mechanism 62 may include a first brake 64 configured to pivot and contact an edge of the first spool 24 which in turn prevents the first spool from rotating. In particular implementations, the first brake may be configured to contact and engage the inner wall 36 of the first spool 24. In other implementations, the first brake may be configured to contact other portions of the first spool in order to prevent the first spool from rotating. Still referring to FIG. 5, the braking mechanism 62 may include a second brake 66 configured to pivot and contact an edge of the second spool 28 which in turn prevents the second spool from rotating. In various implementations, the second brake 66 may be activated independent from the first brake 64 and the first brake 64 may be activated independent from the second brake 66. In particular implementations, the second brake 66 may be configured to contact and engage the inner wall 38 of the second spool 28. In other implementations, the second brake 66 may be configured to contact other portions of the second spool 28 in order to prevent the second spool from rotating. In implementations where the first spool and the second spool can be locked or braked independently, a user may be able to spool a first hose on the first spool 24. The user may then be able to brake or lock the first spool 24 and spool a second hose on a second spool 28 without interference from a rotating first spool.

In other implementations, a single brake may be used to brake multiple spools and prevent multiple spools from rotating. In still other implementations, other braking mechanisms may be used to prevent either the first spool 24, the second spool 28, or both the first spool and the second spool from rotating. Such braking mechanisms may include, by non-limiting example, a pin inserted into a spool which prevents the spool from rotating.

Figure 6:
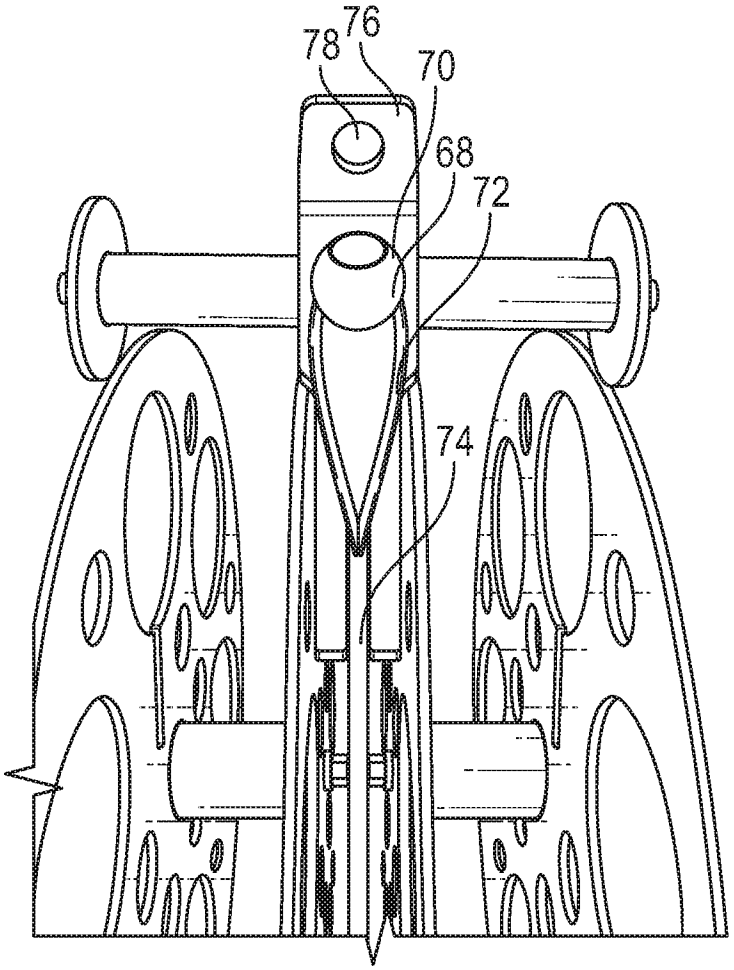
FIG. 6 is a view of a top portion of a spool device.
Figure 7:
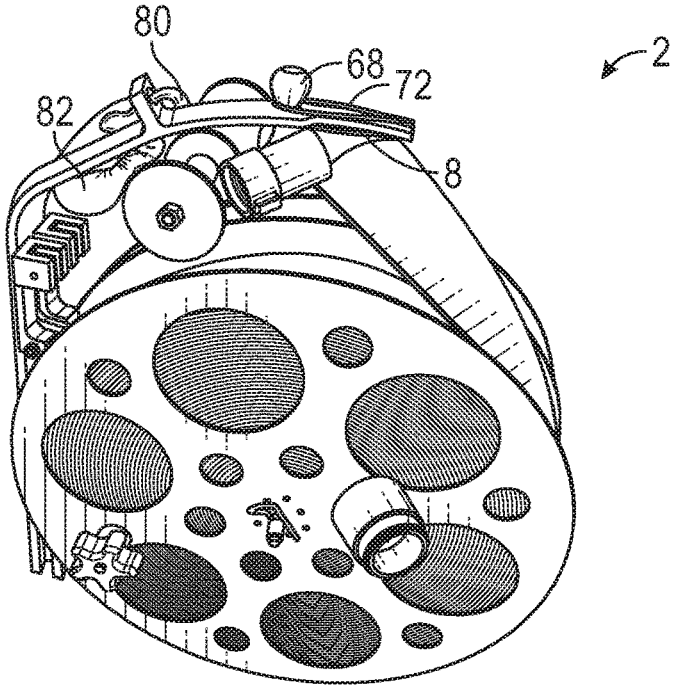
FIG. 7 is a view of a spool device holding a plurality of hoses.
Figure 8:
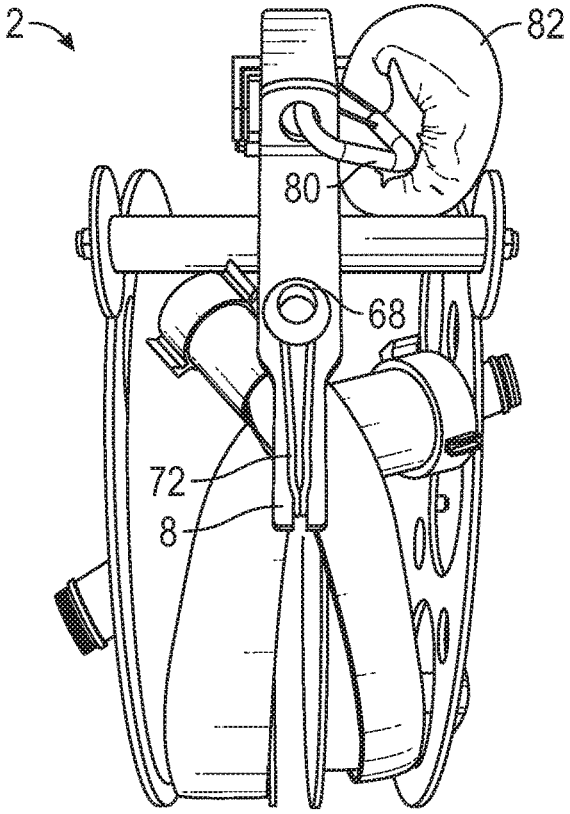
FIG. 8 is a top view of a spool device holding a plurality of hoses.

Referring to FIG. 6, a view of a top portion of a spool device is illustrated. In various implementations, the spool device 2 may include a hose locking mechanism 68 directly coupled to the upper portion 8 of the frame 4. In various implementations, the hose locking mechanism 68 may include a projection 70 directly coupled to the upper portion 8. The hose locking mechanism 68 may also include a cord 72, which may or may not be elastic, coupled to the surface of the upper portion 8 opposite the surface the projection 70 extends from. In various implementations, the cord 72 may form a loop and may be configured to run through a notch 74 formed in the end of the upper portion 8 and couple around the projection 70. Referring to FIG. 7, a perspective side view of a spool device holding a plurality of hoses is illustrated, and referring to FIG. 8, a top view of a spool device holding a plurality of hoses is illustrated. As illustrated by FIGS. 7-8, in various implementations each end of each hose may be held or locked in place between the cord 72 and the upper portion 8. To release the hoses, a user may remove the cord 72 from the projection 70, allowing the cord to hang from a bottom side of the upper portion and the ends of the hoses to be removed.

In other implementations, the hose locking mechanism 68 may be used to hold a gated wye. The gated wye may be coupled to a first hose and a second hose or may be separate from the first hose and the second hose. The gated wye may be held in place by the hose locking mechanism in a position under the upper portion 8 or over the upper portion 8.

Referring back to FIGS. 5-6, in various implementations the upper portion 8 may include a harness coupling protrusion 76 extending away from an upper surface 88 of the frame 4. The harness coupling protrusion 76 may include an opening 78 therethrough. As illustrated by FIGS. 7-8, the spool device 2 may include a harness coupled to the harness coupling protrusion 76. In particular implementations, the spool device 2 may include clip 80 configured to couple through the opening 78 of the harness coupling protrusion.

Referring to FIGS. 7-8, in various implementations the spool device 2 includes a harness bag 82 coupled to the coupling link 80 and configured to hold the straps of a harness when the spool device is not being used to retrieve or deploy hoses.

Figure 9:
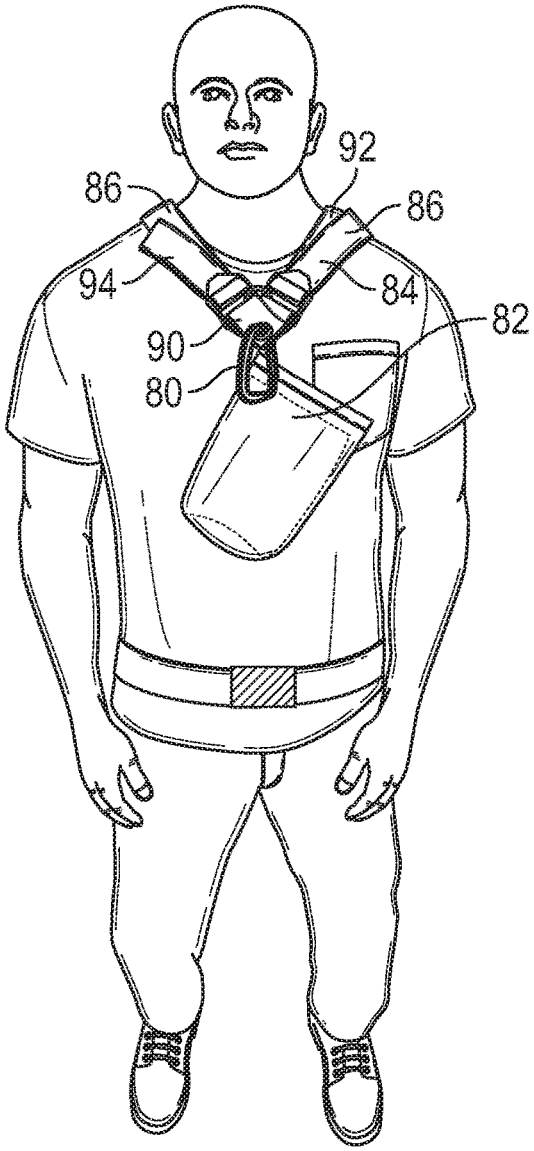
FIG. 9 is a front view of a user wearing a harness.

Referring to FIG. 9, a front view of a user wearing a harness is illustrated. In various implementations, the spool device 2 includes a harness 84. The harness may include a coupling link 80, a harness bag 82, and a plurality of straps 86. As illustrated by FIGS. 7-8, the harness may be configured to directly couple to the upper portion 8 of the frame 4. In various implementations, the coupling link 80 may be configured to directly couple to a V junction 90 and the V junction may be directly coupled to a first shoulder strap 92 and a second shoulder strap 94. In various implementations, each of the shoulder straps may include a buckle or adjuster used to pull the straps 86 tight and hold the spool device 2 close to an individual's body.

Figure 10:
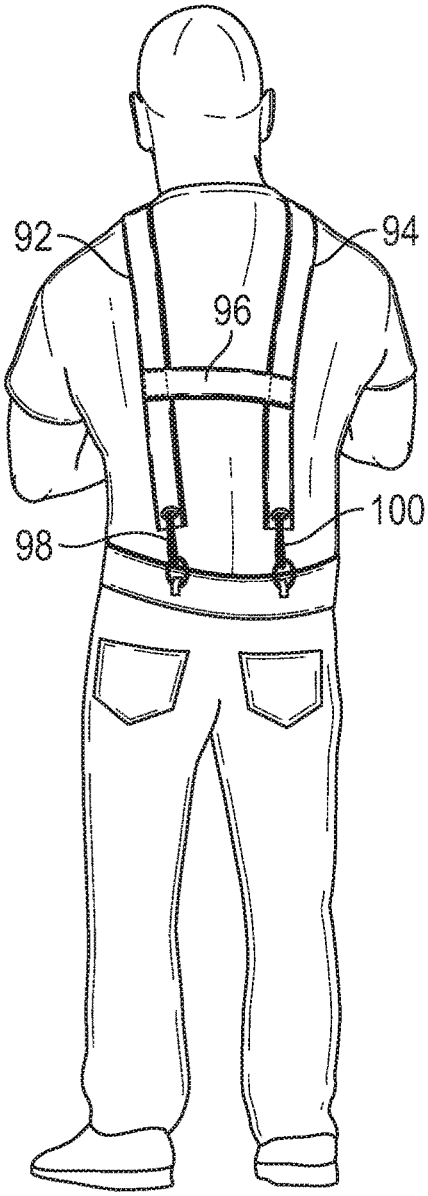
FIG. 10 is a rear view of a user wearing a harness.

Referring to FIG. 10, a rear view of a user wearing a harness is illustrated. In various implementations, the first shoulder strap 92 and the second shoulder strap 94 may be configured to extend from the front of a user, over the user's shoulders, and to the back of a user near the user's waist line. In particular implementations, the harness may include a cross strap 96. In such implementations, the cross strap may be configured to help hold the harness 84 in place when worn by a user. In other implementations, rather than a cross strap the first shoulder strap and the second shoulder strap may be crossed in order to help secure the harness in place. As illustrated by FIG. 10, in various implementations the harness 84 includes a second coupling link 98 directly coupled to an end of the first shoulder strap 92 and a third coupling link 100 directly coupled to the end of the second shoulder strap 94. In various implementations, the second coupling link 98 may be configured to couple directly to a user's clothing and the third coupling link 100 may also be configured to couple directly to a user's clothing. In particular implementations, the second coupling link 98 and third coupling link 100 may be configured to directly couple to a user's belt or to a user's belt loops. In such implementations, the harness is configured to directly couple to only a single point of the frame 4 or of the spool device 2 when the spool device is worn on the front of a user. In other implementations, the straps 86 may be configured to wrap back around a user and to couple to a second and third locations on the frame 4 of the spool device. In such implementations, the straps 86 may be configured to directly couple to the anchor 20.

In other implementations, the spool device may not include a harness. In such implementations, the user may rest the anchor of the spool device on their belt and hold an upright with one hand and spool a hose with the other hand through movement of the spool handle. When one hose is retrieved, the user may grasp the upright with the hand that previously spooled the hose and spool an additional hose with the hand that previously held the upright.

Referring to FIG. 11, the spool device is configured to directly couple to the front of a user. The spool device may be configured to allow the user to spool multiple hoses simultaneously while the spool device is worn by a user. Further, the spool device 2 may be configured to spool one or more hoses while the spool device is carried and moved by a user. In such implementations, the spool device enables a single person to spool multiple hoses in a fast and easy manner. Because the elevation of the spool device when it is used to spool hoses (at the height of the user's chest) in conjunction with the hose rollers, any water or other medium is removed from the hose while the user spools the hoses. Using the spool handles, the user may rotate the one or more spools to pick up the hose or hoses as the user walks and follows the hose or hoses being picked up. In this manner, the user does not have to drag the hoses along the ground, but is able to walk along the hose and around any obstacles to directly pick up the hose from the ground.

Figure 12:
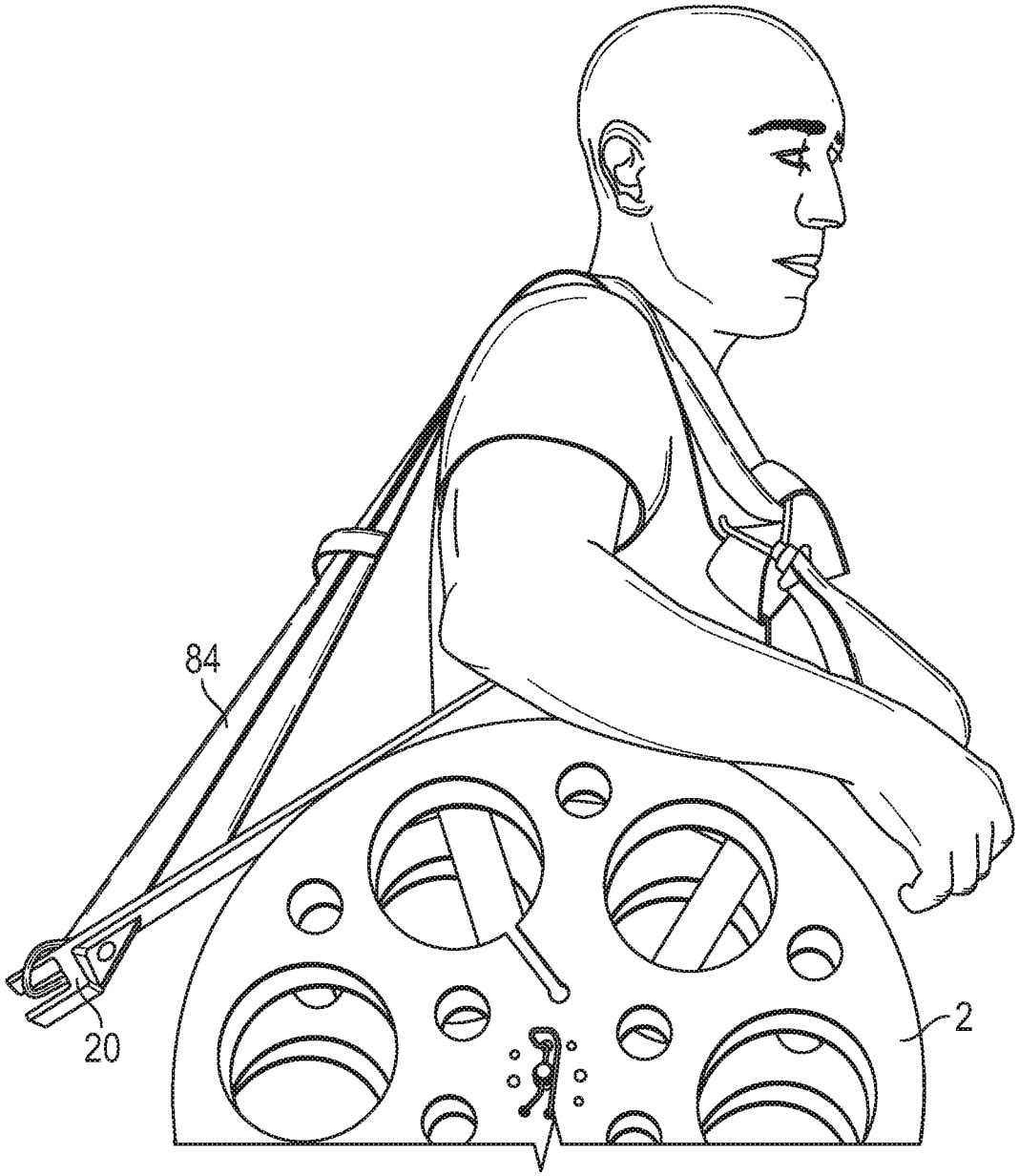
FIG. 12 is a side view of a user carrying the spool device.

Referring to FIG. 12, a side view of a user carrying the spool device is illustrated. As illustrated, when not used to retrieve hoses, the spool device 2 may be easily transported by linking the straps of the harness to the notch of the anchor or to an opening through a support between the upright and the anchor and the coupling link 80 to the harness receiving protrusion 76 and the user using both shoulder straps as a single shoulder strap to carry the spool device 2 over a single shoulder, as illustrated.

Figure 13:
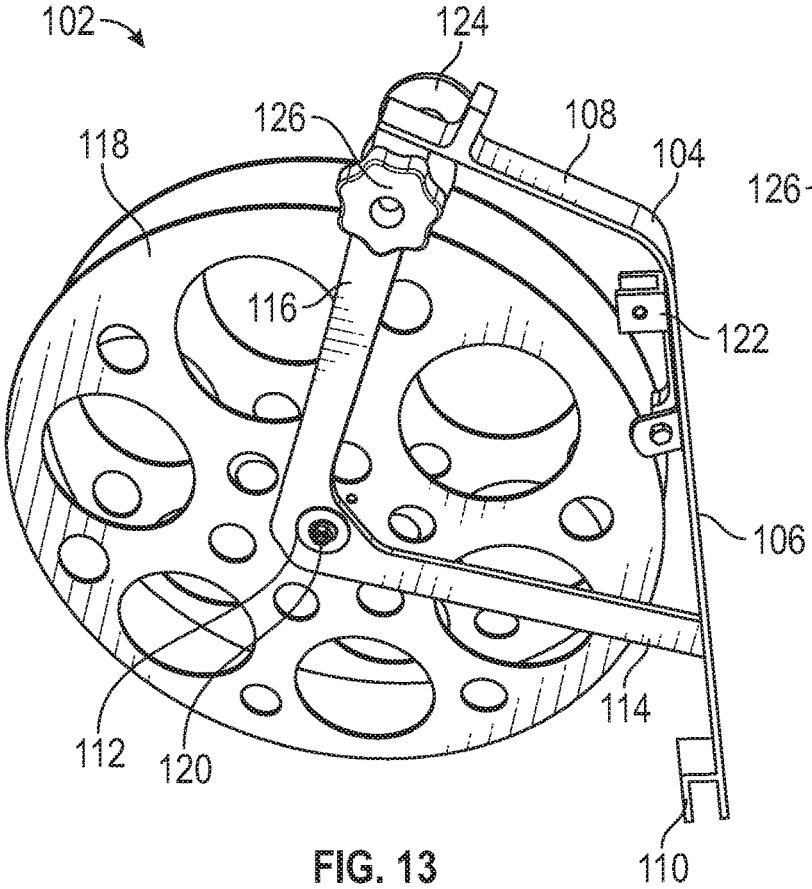
FIG. 13 is a side perspective view of another implementation of a spool device.
Figure 14:
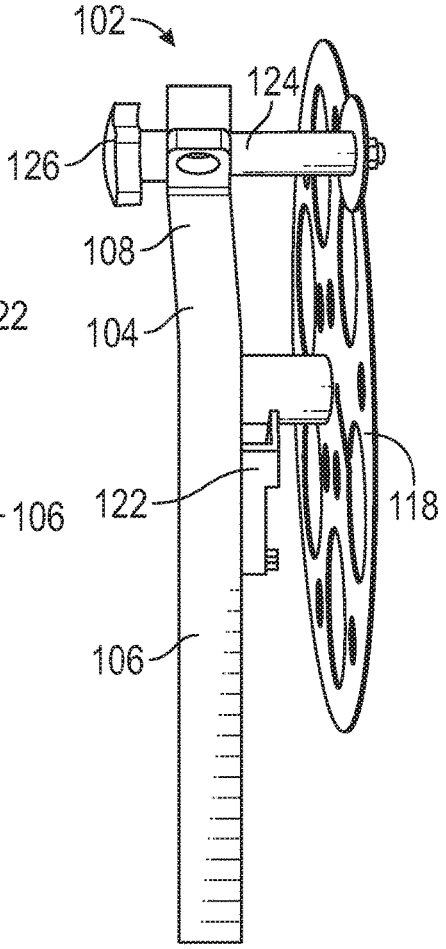
FIG. 14 is a rear view of the spool device of FIG. 13.

Referring to FIG. 13, a side perspective view of another implementations of a spool device is illustrated, and referring to FIG. 14, a rear view of the spool device of FIG. 13 is illustrated. In various implementations, the spool device 102 includes a frame 104 including an upright 106, an upper portion 108, an anchor 110, and an axle receiving portion 112. The upright 106, the upper portion 108, the anchor 110, and the axle receiving portion 112 may be the same as any upright, upper portion, anchor, or axle receiving portion disclosed herein. In various implementations, the frame 104 includes a first support 114 coupled between the upright 106 and the axle receiving portion 112 and a second support 116 coupled between the upper portion 108 and the axle receiving portion. In other implementations, the frame may include more than two supports coupled between the axle receiving portion and the upright and/or upper portion.

As illustrated by FIGS. 13-14, the spool device 102 is configured to carry only a single spool 118, which may be similar to or the same as any spool disclosed herein. Accordingly, the spool device 102 may include an axle 120 extending from a single side of the frame in a manner that allows a spool to be coupled over the axle 120 only on a single side of the frame 104. Similarly, the spool device 102 may include only a single hose roller 124, which may be the same as or similar to any hose roller disclosed herein, and a single brake 122, which may be the same as or similar to any brake or braking mechanism disclosed herein. As illustrated by FIGS. 13-14, the spool device 102 includes a frame handle 126. The frame handle 126 may be configured to allow a user to hold the handle with their left hand to steady the spool device 102 while the user holds a spool handle with their right hand which is moved to rotate the spool 118 and retrieve a hose. In various implementations, the spool device 102 may include a harness, which may be the same as or similar to any harness disclosed herein. In other implementations, the spool device may not include a harness and a user may retrieve a hose by resting the spool device on their belt and winding the spool with one hand while grasping the frame handle 126 or the upright with the other hand. Any other elements of the implementation of the spool device 2 of FIGS. 1-12 may be incorporated into the spool device 102 of FIGS. 13-14 with the understanding that the spool device 102 includes only a single spool and is therefore configured to spool only one hose at a time.

In various implementations, the method of spooling the hose may include attaching the spool device to an individual through the straps of the spool device and adjusting the straps to ensure a secure fit of the spool device. The method may also include draping an end a hose over a hose roller (if included) and out through an opening in an outer wall of a spool. In various implementations, the method may include putting an end portion of the hose in a slot coupled to the opening in the outer wall. The user may secure additional hoses in this manner to other spools. Upon the hose or hoses being coupled to the spool or spools, the user then may rotate each spool using the spool handle. As the handle rotates, the spool device pulls the hose over the hose roller and forces water (or any other medium in the hose) out of the hose. As the user continues to rotate the spool, the hose may be neatly spooled around the hub of the spool. Upon spooling the entire hose, the spool may be locked in place using a braking mechanism or may be removed from the frame and a new empty spool may be placed on the axle and used to retrieve an additional hose. In implementations where the spool is removed after retrieving the hose, because the water (or other medium) has been removed from the hose from the hose roller and because the hose is neatly spooled, the hose may be stored on the spool until it is ready for deployment. Implementations of the spool device disclosed herein enable an individual to hold the spool device and in turn allows an individual to walk with the spool device. Because of the size of the spool device, coupled with the configuration of the straps and frame of the spool device, an individual is able to freely walk/move with ease having the spool device secured to their torso. Accordingly, the individual may be able to spool the hose without having to pull the entire length of the hose while spooling the hose.

In places where the description above refers to particular implementations of spool devices and implementing components, sub-components, methods and sub-methods, it should be readily apparent that a number of modifications may be made without departing from the spirit thereof and that these implementations, implementing components, sub-components, methods and sub-methods may be applied to other spool devices.

What is claimed is:

1. A spool device comprising:

an axle coupled to a frame;

a first spool coupled over a first portion of the axle;

a second spool coupled over a second portion of the axle;

a first spool handle coupled to an outer wall of the first spool;

a second spool handle coupled to an outer wall of the second spool;

a first hose roller coupled to the frame; and a second hose roller coupled to the frame;

wherein the spool device is configured to couple to a front of a user while one or more hoses are spooled onto the spool device.

2. The spool device of claim 1, wherein the frame does not cross a first plane formed by the outer wall of the first spool and the frame does not cross a second plane formed by the outer wall of the second spool.

3. The spool device of claim 1, further comprising a braking system directly coupled to the frame, wherein the braking system is configured to brake the first spool and the second spool through friction.

4. The spool device of claim 1, wherein the first spool is configured to rotate independently from the first hose roller and the second spool is configured to rotate independently from the second hose roller.

5. The spool device of claim 1, wherein the frame is configured to directly couple to a belt of the user.

6. The spool device of claim 1, wherein the first spool is configured to rotate independently from the second spool.

7. A spool device comprising:

a frame comprising an anchor, the anchor configured to directly couple to a belt of a user;

an axle coupled to the frame;

at least one spool coupled to the axle;

a spool handle directly coupled to an outer wall of the at least one spool;

a hose roller coupled to the frame.

8. The spool device of claim 7, wherein the at least one spool is configured to rotate independently from the first hose roller.

9. The spool device of claim 7, further comprising a hose locking mechanism directly coupled to an upper portion of the frame.

10. The spool device of claim 7, wherein the at least one spool comprises two spools.

11. The spool device of claim 7, further comprising a harness, the harness comprising a first latch configured to couple to an upper portion of the frame, a second latch configured to directly couple to a user's clothing, and a third latch configured to directly couple to the user's clothing.

12. The spool device of claim 7, wherein the hose roller is coupled entirely outside of the at least one spool.

13. The spool device of claim 7, wherein the spool device is configured to allow the user to spool one or more hoses while the spool device is carried by the user.

14. A spool device comprising:

a frame comprising an anchor comprising a U shape portion, the U shape portion configured to directly couple to and over a belt of a user;

a harness directly coupled to the frame;

an axle coupled to the frame;

a first removable spool coupled over a first portion of the axle;

a second removable spool coupled over a second portion of the axle;

a first spool handle coupled to an outer wall of the first removable spool; and a second spool handle coupled to an outer wall of the second removable spool;

wherein the spool device is configured to allow the user to spool multiple hoses simultaneously while moving.

15. The spool device of claim 14, wherein the harness is configured to directly couple to only a single point of the frame.

16. The spool device of claim 14, further comprising:

a first and second brake coupled to frame.

17. The spool device of claim 14, further comprising a hose locking mechanism directly coupled to the frame.

18. The spool device of claim 14, further comprising a first hub lock configured to secure the first removable spool over the first portion of the axle and a second hub lock configured to secure the second removable spool over the second portion of the axle.

19. The spool device of claim 14, wherein the first removable spool and the second removable spool are configured to rotate independently from one another.

20. The spool device of claim 14, wherein the frame does not cross a first plane formed by the outer wall of the first removable spool and the frame does not cross a second plane formed by the outer wall of the second removable spool.

* * * * *